US005841450A

United States Patent [19]

Kawamura

[11] Patent Number: 5,841,450

[45] Date of Patent: Nov. 24, 1998

[54] INK JET PRINT RECORDING APPARATUS

[75] Inventor: Hiroki Kawamura, Nisshin, Japan

[73] Assignee: Brother Kogyo Kabushiki Kaisha, Nagoya, Japan

[21] Appl. No.: 570,935

[22] Filed: Dec. 12, 1995

[30] Foreign Application Priority Data

Dec. 26, 1994 [JP] Japan ..... 6-337784

[51] Int. Cl.[6] ..... B41J 2/165

[52] U.S. Cl. ..... 347/32

[58] Field of Search ..... 347/29, 31, 32, 347/37, 104; 400/120.5, 120.16, 294, 319, 320

[56] References Cited

U.S. PATENT DOCUMENTS 4,444,521 4/1984 Kickard et al. ..... 400/120

5,008,684 4/1991 Kurafuji ..... 347/197

5,587,729 12/1996 Lee et al. ..... 347/32

5,645,362 7/1997 Aizawa et al. ..... 400/643

*Primary Examiner*—Matthew V. Nguyen

*Attorney, Agent, or Firm*—Oliff & Berridge, PLC

[57] ABSTRACT

In an ink jet type print recording apparatus, a predetermined number of pulses are first produced in a positive direction when gear disengagement is carried out to drive an line feed motor in a forward direction at an angular amplitude within a half of a gear tooth width. Subsequently, pulses whose number is twice as large as the predetermined number are produced in the opposite direction to drive the line feed motor in the reverse direction. Subsequently, a predetermined number of pulses are produced in the positive direction again to drive the line feed motor in the forward direction. With this operation, an idle gear is smoothly disengaged from a link target gear. The line feed motor is reciprocatively driven in the same manner as described above when the idle gear is linked to a new link target gear.

20 Claims, 12 Drawing Sheets

INK JET PRINT RECORDING APPARATUS

BACKGROUND OF THE INVENTION

1. Field of the Invention

The invention relates to an ink jet print recording apparatus in which a driving motor is commonly used for both a sheet feeding system and a head recovering system and a driven system (called a driving or link target) is altered by switching a gear linkage. More particularly, the invention relates to an ink jet print recording apparatus in which a driving side gear is slightly, reciprocatively rotated by the driving motor when the driving side gear is linked to a driven side gear, whereby the linkage between the driving side gear and the driven side gear can be smoothly performed.

2. Description of Related Art

A print recording apparatus, such as a copying machine, a facsimile machine or a printer for a personal computer, in which a dot pattern image is formed on a print medium, such as a sheet or a plastic sheet, on the basis of transferred print information is the subject of the invention. One known type of print head mounted at a print portion of the print recording apparatus is an ink jet print head for jetting small ink droplets from an ink discharge port (nozzle) to a print medium, such as a paper sheet, to attach the ink droplets onto the print medium, thereby performing a print operation.

According to this type of ink jetting print head, there are times when bubbles occur in the ink stored in the print head during use. The occurrence of the bubbles causes a failure in ink jetting. Accordingly, in order to avoid such an ink jetting problem, cleaning and removing the cause of the ink jetting failure and return to a good ink jetting state must be periodically performed. Therefore, a purge pump, driven by a motor, is provided to periodically carry out a purge operation by sucking defective ink from the ink jetting face using a negative pressure produced by the purge pump.

It is possible to provide a motor which is exclusively used to drive the purge pump. However, in many printer recording apparatuses the driving motor used to drive a sheet feeding platen roller also functions as the motor for driving the purge pump. With these machines, the purge pump and the platen roller are selectively driven by switching a link gear. This is done because, as the number of motors increases, the total weight and the overall size of the print recording apparatus increases because of the number of motors and their weight.

A link gear group in a print recording apparatus, such as described above, is shown in FIG. 12.

The gear group shown in FIG. 12 comprises a motor gear 137 provided to a motor shaft 129A, a purge gear 142 for rotating a pump cam 119 for controlling the motion of a piston (not shown) of a purge pump (not shown), a platen gear 107 provided to a platen roller shaft 106A, and an idle gear 141 which is located at a center portion of the above three gears. The idle gear 141 is movable along an idle gear shaft 145 in the directions indicated by arrows A and B.

A gear tooth of the idle gear 141 is engagedly linked to the motor gear 137 at all times so that the idle gear 141 is driven by the motor 129 at all times. When the idle gear 141 is moved in a direction as indicated by the arrow A, the idle gear 141 is engagedly linked to the purge gear 142 to transmit the driving force of the motor 129 to the purge system. At this time, the idle gear 141 is disengaged from the platen gear 107, that is, the idle gear 141 is not linked to the platen gear 107. This is because an operation failure may occur due to insufficient torque of the motor if the purge system and the sheet feeding system are simultaneously driven.

On the other hand, when the idle gear 141 is moved in the direction indicated by arrow B, the idle gear 141 is engagedly linked to the platen gear 107, and the driving force of the motor 129 is transmitted to a platen roller shaft 106A. At this time, the idle gear 141 is disengaged from the purge gear 142, that is, the idle gear 141 is not linked to the purge gear 142.

The switching operation between the two engaging states as described above is performed as follows. That is, a carriage which is mounted to be movable in parallel to the platen roller and on which a print head is mounted, kicks a kick portion 146 of a kick member 144 for moving the idle gear 141 to rotate an idle kicker 143 and move the idle gear 141 in the directions as indicated by the arrows A and B. However, when the switching operation is carried out, the idle gear 141 is not necessarily smoothly linked to the purge gear 142 or platen gear 107 due to phase shift between the gears caused by backlash of the gears, distortion of the gear shafts or similar effects.

In view of the foregoing, it has been hitherto adopted that the gear tooth 139 of the idle gear 141 or the tooth end of the purge gear 142 is designed in a tapered form to guide (or lure in) the tooth end of the opposing, or meshing, gear (FIG. 13), or that the rotational angle of the motor is adjusted so that the phase is coincident between the gears to thereby perform a smooth linkage.

However, the conventional ink jet type print recording apparatus as described above has the following problems.

That is, even when the tooth end of the gear is designed in a tapered form or the phase adjustment is performed through the motor driving control, the smooth switching operation of the gear linkage can not be easily performed for various reasons. Accordingly, the apparatus falls into an error state or the kick member or the gears are worn or damaged. The causes of such troubles will be described in detail.

First, there is a problem in linkage between the idle gear 141 and the other gears. For the gears engaging the idle gear 141, there is provided some degree of backlash between each gear and the support shaft for convenience in fabrication. Further, the gear shaft of each gear itself is not necessarily a perfect rigid body, so that slight distortion is caused in the gear shaft by a load. Particularly, with respect to the platen roller shaft 106A of the platen gear 107, the platen roller itself has a large weight and the mechanical load to feed a sheet is large. Thus, the degree of distortion frequently exceeds a negligible range. Therefore, even if a phase adjustment by the driving motor is carried out, the phase of the gears is not coincident at the actual gear end position and the linkage of the gears cannot be smoothly performed even by guiding the gears along the tapered gear ends.

Secondly, there is a problem in disengagement between the idle gear 141 and the other gears. For example, if distortion occurs in the platen roller shaft 106A as described above, in a state where the idle gear 141 is linked to the platen gear 107, a strong frictional force occurs between the tooth face of the idle gear 141 and the tooth face of the platen gear 107. Therefore, the idle gear 141 is prevented from moving along the idle gear shaft 145 in the direction indicated by arrow A of FIG. 12. Thus, it is very difficult to disengage the gears. In such a situation, the idle gear 141 cannot be smoothly linked to the purge gear 142. Neither the phase adjustment through the motor driving operation nor the taper design of the tooth ends can solve the above problem. Further, the same problem occurs when the linkage is switched from the purge gear 142 to the platen gear 107.

SUMMARY OF THE INVENTION

An object of the invention is to provide an ink jet type print recording apparatus in which a driving side gear is slightly reciprocatively rotated by a driving motor when a gear link transfer, from a driving motor, is switched between a sheet feeding system and a head recovering system, thereby smoothly performing the gear engagement (linkage) and disengagement (release) between the various gears.

In order to attain the above object, the ink jet type print recording apparatus of the invention which includes an ink jet type print head for jetting ink from an ink discharge port (nozzle) onto a print medium to print an image on the print medium, recovering means for recovering the print head, a feeding roller for feeding the print medium and a driving motor for driving the recovery means and the feeding roller, comprises a recovery gear provided to the recovery means, a feeding gear provided to the feeding roller, a transmission gear which is driven by the driving motor and switchably (selectively) linked to one of the recovery gear and the feeding gear, and engagement control means for controlling the driving motor to reciprocatively rotate the transmission gear in an angular range which is equal to or smaller than one half of the tooth width of the transmission gear when a link target (recovery gear or feeding gear) of the transmission gear is switched, thereby performing a smooth gear switching operation, when the transmission gear is moved in a axial direction to switch its link target.

In the ink jet type print recording apparatus of the invention, the recovery means may comprise a suction pump for sucking ink from the ink discharge port of the print head to recover, that is, clean, the print head, a carriage which is movable in parallel to the feeding roller and on which the print head is mounted, and switching means for moving the transmission gear in the shaft, or axial, direction to switch the link target, i.e., the system to be engaged, interlockingly with the movement of the carriage. The engagement control means may drive the driving motor when the transmission gear is disengaged from the link target by the switching means, and also drive the driving motor when the transmission gear is linked to a new link target.

In the ink jet type print recording apparatus of the invention thus structured, when the transmission gear is moved in the shaft direction, the link target is switched between the recovery gear and the feeding gear. When the transmission gear is linked to the recovery gear, the driving force of the driving motor is transmitted to the recovery means to recover the print head. On the other hand, when the transmission gear is linked to the feeding gear, the driving force of the driving motor is transmitted to the feeding roller to feed the print medium. When the gear switching operation is carried out, the engagement control means controls the driving motor so that the transmission gear is reciprocatively rotated in an angular range which is less than or equal to a half of the tooth width of the transmission gear, whereby the gear switching operation can be smoothly performed.

Furthermore, in the ink jet type print recording apparatus of the invention, when the carriage is shifted, the transmission gear is moved in the shaft direction through the switching means interlockingly with the shift of the carriage to switch the link target of the transmission gear. At the time when the transmission gear is disengaged from the link target, the driving motor is actuated by the switching means and the gear switching operation is smoothly performed.

In the ink jet type print recording apparatus of the invention, when the transmission gear is linked to a new link target, the driving motor is also actuated by the switching means and the gear switching operation is smoothly performed.

In the ink jet type print recording apparatus of the invention, when the transmission gear is linked to the recovery gear and the driving force of the driving motor is transmitted, the ink is sucked from the ink discharge port of the print head by the suction pump to recover, or clean, the print head.

According to the ink jet type print recording apparatus of the invention as described above, the apparatus is provided with a transmission gear which is driven by the driving motor and switchably linked to one of the recovery gear and the feeding gear, and also provided with the engagement control means for controlling the driving motor so that the transmission gear is reciprocatively rotated in an angular range which is less than or equal to half of the tooth width of the transmission gear when the link target of the transmission gear is switched, so that the switching operation of the link target of the transmission gear can be smoothly performed.

Furthermore, the apparatus is also provided with the switching means for moving the transmission gear in the shaft direction interlockingly with the shift of the carriage to switch the link target of the transmission gear, and the engagement control means controls the driving motor to perform a reciprocative rotational motion when the transmission gear is disengaged from the link target by the switching means, so that the disengagement of the gears can be smoothly performed even when the transmission gear and the link target gear are closely contacted with each other due to distortion of the gear shaft, or other factors, to create a strong frictional force therebetween.

When the transmission gear which is disengaged from a link target is engaged with a new link target by the switching means, the engagement control means controls the driving motor to perform a reciprocative rotational motion, so that the gear linkage (engagement) can be smoothly performed even when there is phase shift between the transmission gear and the link target. Furthermore, when the transmission gear is linked to the recovery gear by the switching means and the engagement control means, the ink is sucked from the ink discharge port of the print head by the suction pump serving as the recovery means to remove defective ink and recover the print head into an excellent ink discharge state.

BRIEF DESCRIPTION OF THE DRAWINGS

A preferred embodiment of the invention will be described in detail with reference to the following figures wherein.

DETAILED DESCRIPTION OF PREFERRED EMBODIMENT

An ink jet type print recording apparatus according to the invention will be described with reference to the accompanying drawings. The embodiment of the invention is described in the context of application to an ink jet printer connected to a print instruction device, such as a personal computer.

First, the structure of the ink jet printer according to the embodiment will be described with reference to FIGS. 1 to 8.

Figure 1:
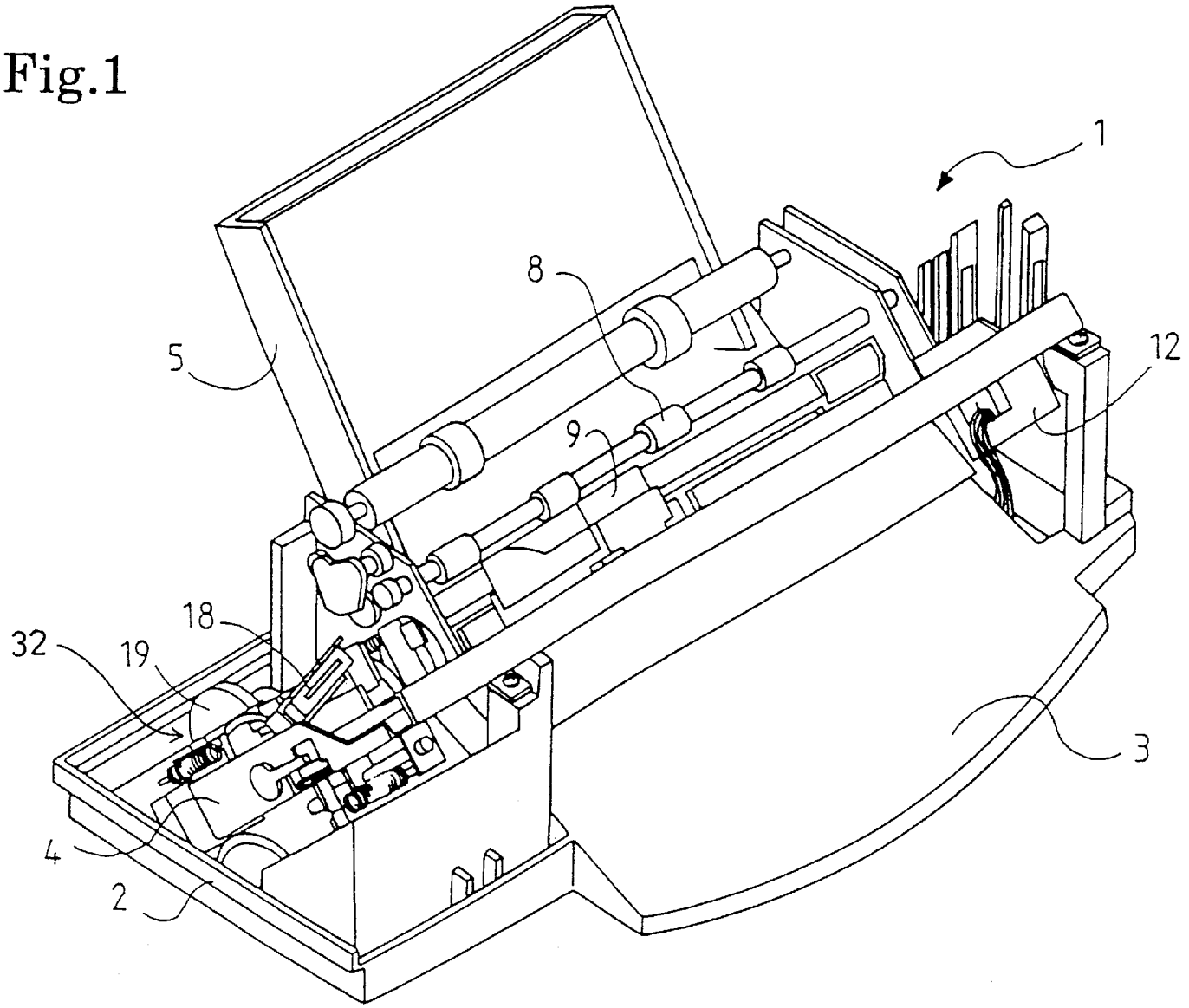
FIG. 1 is a perspective view showing an upper portion of an ink jet printer according to an embodiment of the invention.

FIG. 1 is a perspective view showing the top portion of an ink jet printer. In FIG. 1, a manual sheet supply portion 3 is provided at the front side of a main body frame 2 (all directions are from the perspective of an operator facing the printer) of an ink jet printer 1. A subframe 4 containing a print head 10 (FIG. 2), a purge mechanism 32 and a sheet feeding mechanism LM are mounted to the rear of the manual sheet supply portion 3 and at the upper part of the main body frame 2. Detachably mounted at the upper part and rear of the subframe 4 is a sheet supply cassette 5 in which plural print sheets are stocked.

Figure 2:
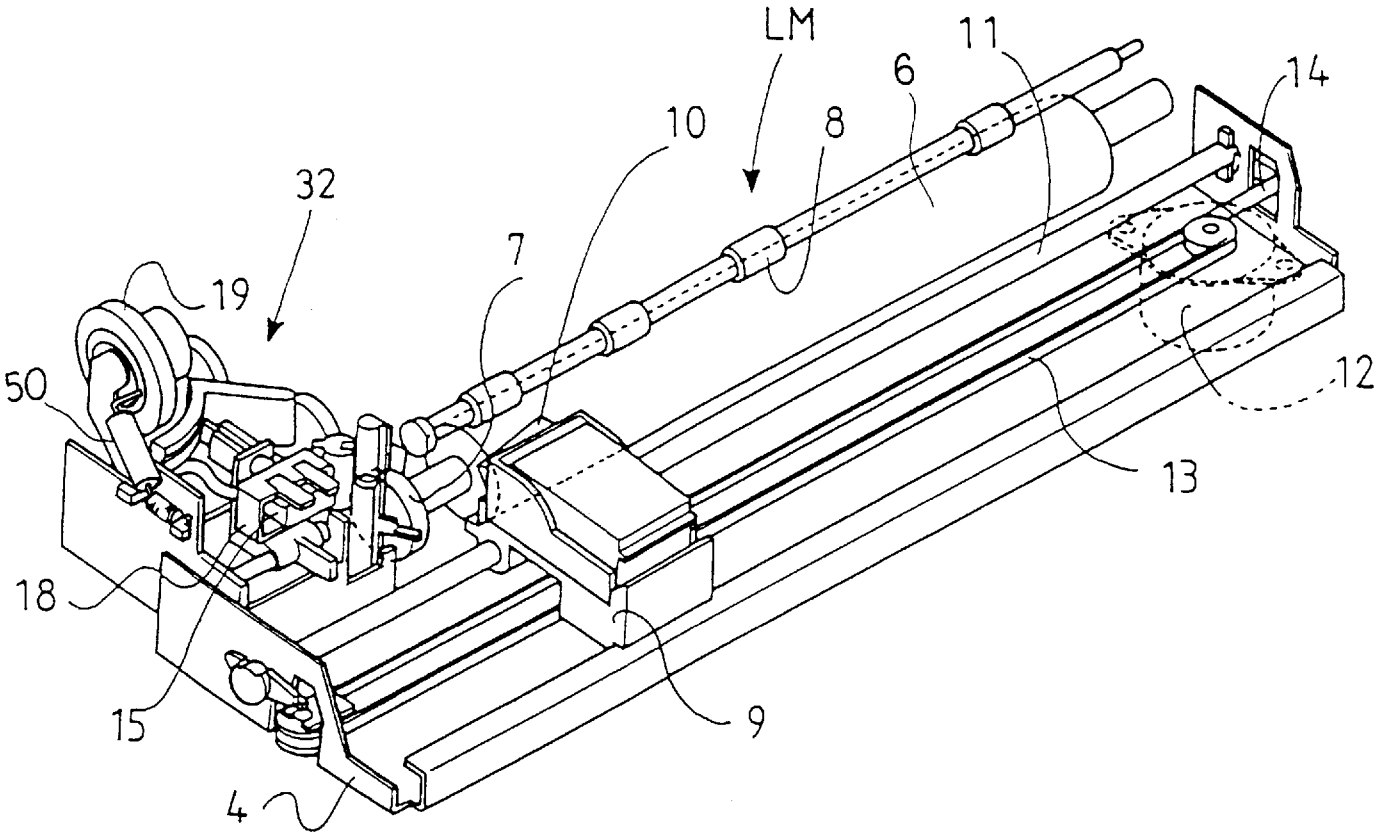
FIG. 2 is a perspective view showing a purge mechanism and a sheet feeding mechanism of the ink jet printer.

FIG. 2 is a perspective view of the subframe 4 and the print head 10, the purge mechanism 32, the sheet feeding mechanism LM, and other elements to be discussed contained in the subframe 4.

In FIG. 2, a cylindrical platen roller 6 is disposed at the rear of the inner portion of the subframe 4. The platen roller 6 is part of the sheet feeding mechanism LM and feeds a print sheet supplied from the sheet supply cassette 5 or from the manual sheet supply portion 3 while the print sheet faces the print head 10. Provided at the upper side of the platen roller 6 is a pressure roller 8 which serves to cause the print sheet to contact the platen roller 6. The platen roller 6 is driven, through a platen gear 7, by an line feed (LF) motor 29 shown in FIGS. 4 and 5.

A carriage 9 is provided in front of the platen roller 6. The carriage 9 has the ink jet type print head 10 mounted thereon and is movable along a carriage shaft 11 which parallels the platen roller 6 so that the print head 10 is moved along the platen roller 6. A carriage (CR) motor 12 for driving the carriage 9 is disposed on the back surface of the right portion of the subframe 4. The CR motor 12 drives the carriage 9 by means of a belt 13. A stepping motor, or a DC motor, is used as the CR motor 12. A tape-shaped position gage 14 with scales is disposed along the belt 13.

The purge mechanism 32, serving as a recovery means for the print head 10, is disposed at the left side of the platen roller 6. When the ink jet type print head 10 has a ink-jet failure problem, caused by bubbles in the ink during use or the attachment of ink droplets on the ink discharge face or to avoid the problems, the purge mechanism 32 for recovering the print head to a normal operating state is provided. The purge mechanism 32 is provided with a purge device 18 which abuts against an orifice serving as the ink discharge face of the print head 10 to suck the bubbles of the ink from the print head 10 as well as to remove dust and dried ink.

A cap 15 is provided at the tip portion of the purge device 18 to abut against the orifice serving as the ink discharge face of the print head 10. The purge device 18 produces a negative pressure using a known pump 50 when the print head 10 is covered by the cap 15 to suck the defective ink from the print head 10 in order to recover the print head to a proper operating state. The pump 50 of the purge device 18 is driven through a pump cam gear 19 by the LF motor 29.

Figure 3:
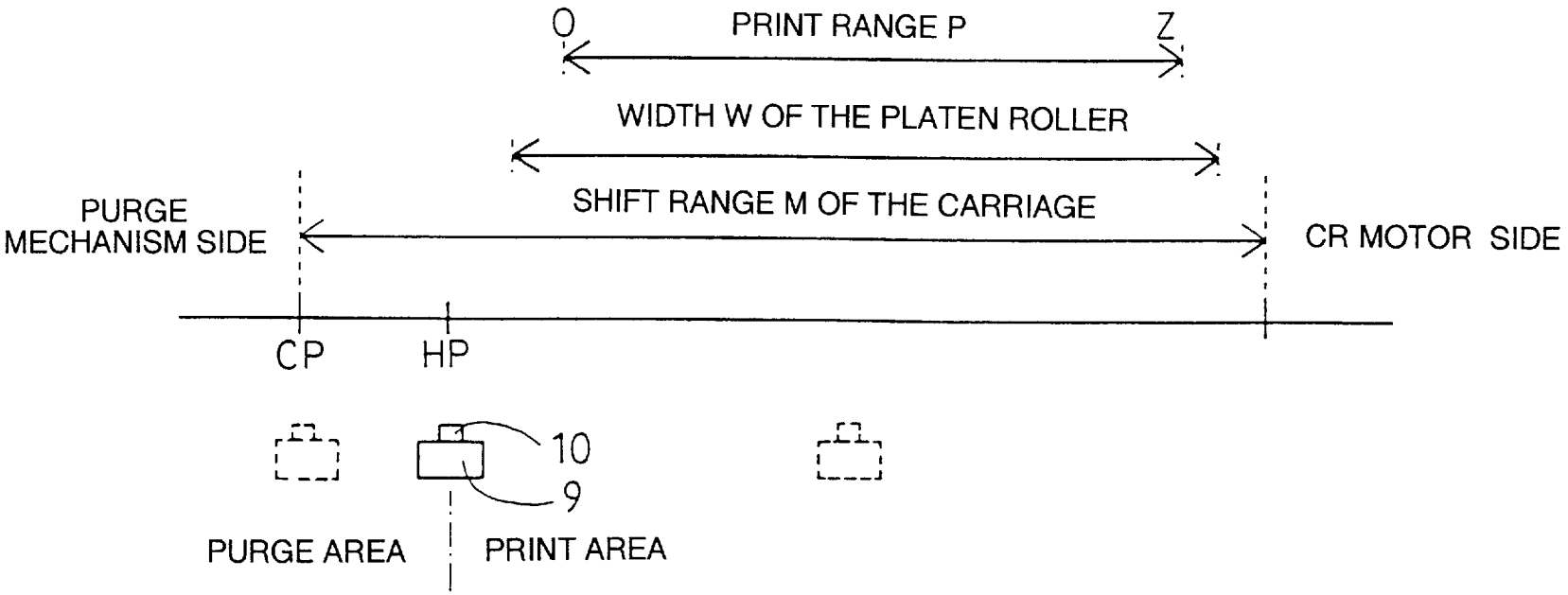
FIG. 3 is a diagram showing the positional relationship in a purge area and a print area within a carriage shift range.

The relationship between the carriage shift range, the position at which the purge device 18 is covered by the cap 15 and the print sheet pass range on the platen roller 6 will be described with reference to FIG. 3. In FIG. 3, the axis represents the position of the carriage 9, and the left side of FIG. 3 corresponds to the left side of FIG. 2 (the purge mechanism 32 side) while the right side of FIG. 3 corresponds to the right side of FIG. 2 (the CR motor 12 side). The shift range M of the carriage 9 is set to be larger than the width W of the platen roller 6. A standby position HP of the carriage 9 and a position CP at which the purge device 18 is covered by the cap 15 are set to the left of the width W. The print sheet passes through the area of the width W. A print range extending from a line head print position 0 to a line end print position Z is within the platen roller width W, and the shift speed of the carriage 9 is set to a predetermined print speed in this range. Hereinafter, the side extending to the left of the standby position HP is referred to as the "purge area", and the side extending to the right of the standby position HP is referred to as the "print area".

Figure 4:
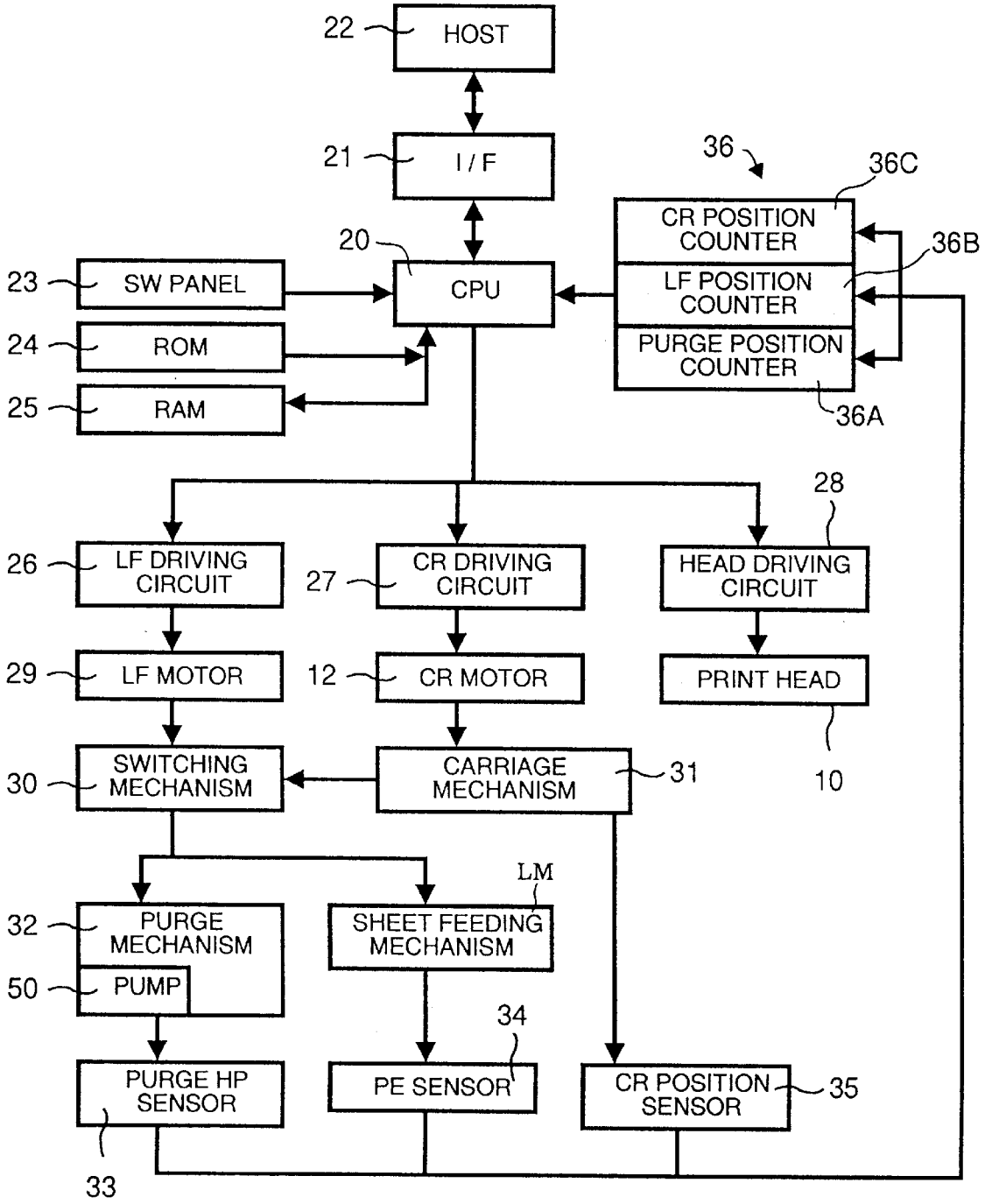
FIG. 4 is a block diagram showing a control apparatus of the ink jet printer.

Next, the controller of the ink jet printer 1 will be described with reference to the block diagram of FIG. 4. The controller has a CPU 20 serving as a the calculation processing device as a main element.

The CPU 20 is connected, through an interface 21, to a host 22 which is an external piece of equipment. The host 22 may be any device for outputting print information, such as a personal computer. That is, the ink jet printer of this embodiment receives a print instruction from the host 22 and executes the printing in accordance with the print instruction.

The CPU 20 is connected to a switch panel 23, a ROM 24 and a RAM 25. The switch panel 23 serves to set and display various parameters, such as a sheet size. The ROM 24 serves to store the programs required to control the ink jet printer 1. An LF correcting program to correctively drive the LF motor 29 when a gear switching operation of a switching mechanism 30, as described later, is carried out as stored in the ROM 24. The RAM 25 serves to temporarily store print data transferred from the host 22 and data required to control the ink jet printer 1.

The CPU 20 controls the driving of the LF motor 29, the CR motor 12 and the print head 10 through the LF driving circuit 26, the CR driving circuit 27 and the head driving circuit 28. The LF motor 29 selectively drives one of the purge mechanism 32 and the sheet feeding mechanism LM through the switching mechanism 30. A stepping motor or a DC motor is used as the LF motor 29.

The purge mechanism 32 comprises the purge device 18, the pump 50, and the pump cam gear 19, and the sheet feeding mechanism LM comprises the platen roller 6 and the pressure roller 8. The CR motor 12 drives a carriage mechanism 31 comprising not only the carriage 9, but also the belt 13, and a pair of pullies. The switching operation of the switching mechanism 30 is carried out interlockingly with the shift of the carriage 9.

Each of the purge mechanism 32, the sheet feeding mechanism LM and the carriage mechanism 31 is provided with a sensor. The sensors output their detection signals respectively to a counter group 36 provided to the CPU 20.

When a piston (not shown) of the pump 50 is located at an original position (that is, the rotational angle of the pump cam gear 19 is located at an origin), the purge HP sensor 33 for the purge mechanism 32 informs a purge position counter 36A of the counter group 36 of the detection result setting the signal as a reference for the purge operation of the purge mechanism 32.

The PE sensor 34 for the sheet feeding mechanism LM outputs a signal in response to the leading of a newly-supplied print sheet and informs an LF position counter 36B of the counter group 36 of the detection result setting the signal as a reference for the print position control operation in a longitudinal direction.

The carriage mechanism 31 is provided with a carriage (CR) position sensor 35. The CR position sensor 35 counts a driving pulse of the CR motor 12 to detect the position of the carriage 9 and informs a CR position counter 36C of the counter group of the detection result. The position information is set not only as a reference for the print position control in a lateral direction, but also as a reference for a judgment whether a correcting operation for the LF motor 29 is carried out, on the basis of the positions before and after the movement of the carriage 9 when the carriage 9 is shifted.

Figure 5:
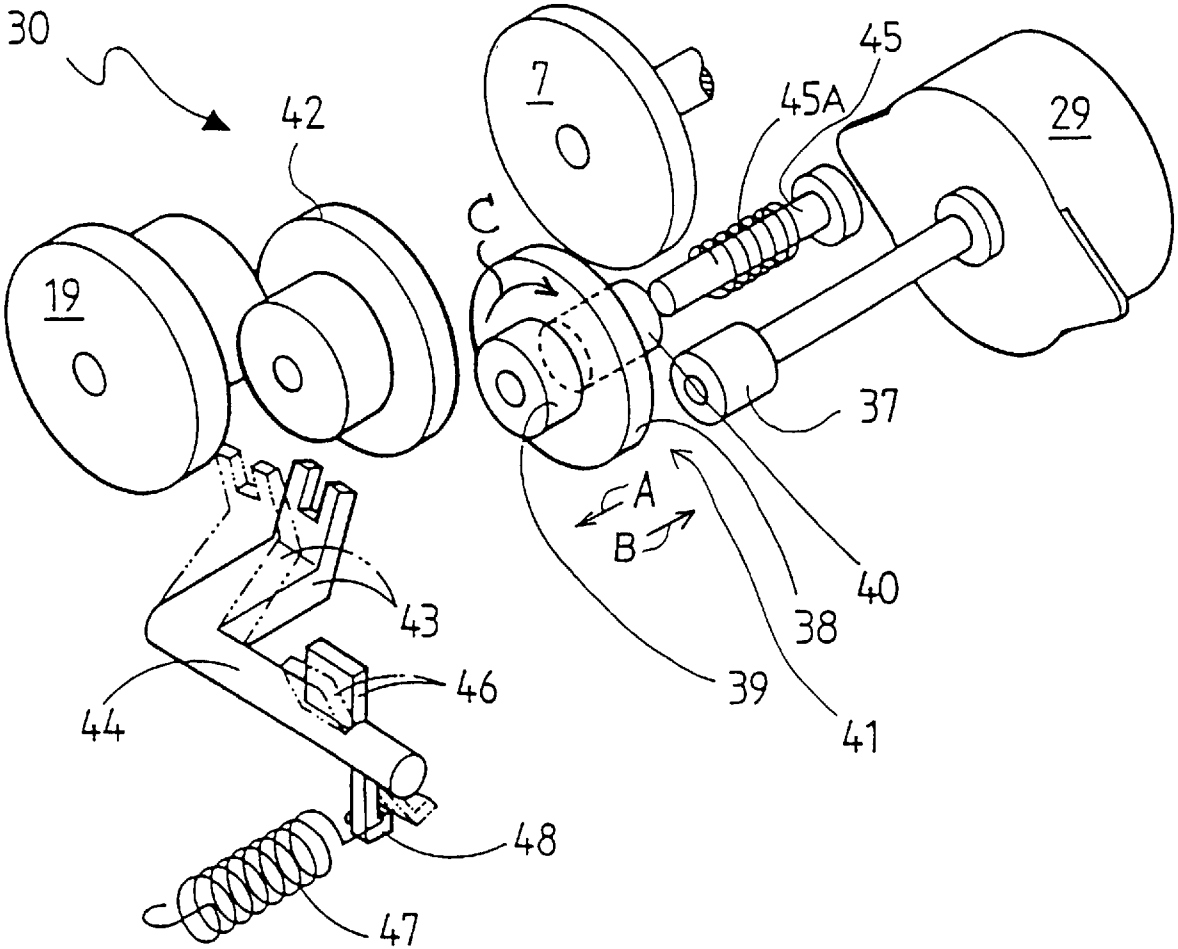
FIG. 5 is a diagram showing the structure of a switching mechanism of a transmission gear.

The switching mechanism 30 will be described with reference to FIG. 5. As described above, the switching mechanism 30 switches a transmission target of the driving force of the LF motor 29 between the purge mechanism 32 and the sheet feeding mechanism LM. FIG. 5 shows the gear group which constitutes the switching mechanism 30. The switching mechanism 30 comprises an idle gear 41 which is movable in an axial direction, as indicated by arrows A,B, of the idle gear shaft 45, an idle kicker 43 which drives the idle gear 41 to move in the axial direction of the idle gear shaft 45, and a compression spring 45A for urging the idle gear 41 in the direction indicated by the arrow A. In FIG. 5, the parts are illustrated as being separated from one another to assist in understanding the embodiment, however, the parts are actually disposed to be more adjacent to one another in the right and left direction, i.e., in a direction parallel to the axial direction indicated by arrows A,B.

The idle gear 41 comprises three tooth gears. Tooth gear 38 engages with a motor gear 37 having the same shaft as the LF motor 29, tooth gear 40 which engages with the platen gear 7 having the same shaft as the platen roller 6 shown in FIG. 2, and tooth gear 39 engages with the purge gear 42 for transmitting the driving force to the pump cam gear 19. The tooth gear 38 and the motor gear 37 are engaged with each other at all times. One of the engagement between the tooth gear 40 and the platen gear 7 and the engagement between the tooth gear 39 and the purge gear 42 is selected through the movement of the idle gear 41 in the shaft (axial) direction.

An idle kicker 43, a kick portion 46 and a spring hook 48 are secured to a kicker shaft 44 which is provided to be rotationally moved around its axis. The idle kicker 43 is maintained in one of two states, as indicated by the solid line and the two-dotted chain line, through the rotational motion of the kicker shaft 44 around its axis. A pull spring 47 is hooked to a spring hook 48, and urges the idle kicker 43, with its elastically pulling (contracting) force to the position indicated by the solid line. The elastic pulling force of the pull spring 47 is set to be stronger than the elastic expansion force of the compression spring 45A.

The kick portion 46 is provided at such a position that it projects into the shift, or movement, range of the carriage 9. Therefore, when the carriage 9 is shifted from the standby position HP, shown in FIG. 3, to the purge position CP, the lower portion of the carriage 9 strikes the kick portion 46, so that the kick portion 46 is moved to the state shown by the two-dotted chain line. Usually, the kick portion 46 is urged by the elastic pulling force of the pull spring 47 to the position shown by the solid line.

When in the position shown by the solid line, the idle kicker 43 presses the idle gear 41 in the direction of arrow B against the urging force of the compression spring 45A. Therefore, the tooth gear 40 of the idle gear 41 is engaged with the platen gear 7 and the driving force of the LF motor 29 is transmitted to the platen roller. In that position, the tooth gear 39 and the purge gear 42 are not engaged with each other and, thus, the pump cam gear 19 is not driven. The link status of each gear in this state is shown in the cross-sectional view of FIG. 7.

On the other hand, when the carriage 9 is located at the purge position CP, the idle kicker 43 is set to the position shown by the two-dotted chain line overcoming the urging of the pull spring 47 by the contact of the carriage 9 with the kick portion 46. In this position, the idle gear 41 is pushed in the direction of arrow A by the compression spring 45A and the tooth gear 39 engages the purge gear 42. Thus, the driving force is transmitted to the pump cam gear 19 and the purge mechanism 32 is driven. At this time, the tooth gear 40 and the platen gear 7 are disengaged and the platen roller 6 is not driven. The link status of each gear in the above state is shown in the cross-sectional view of FIG. 8.

Figure 7:
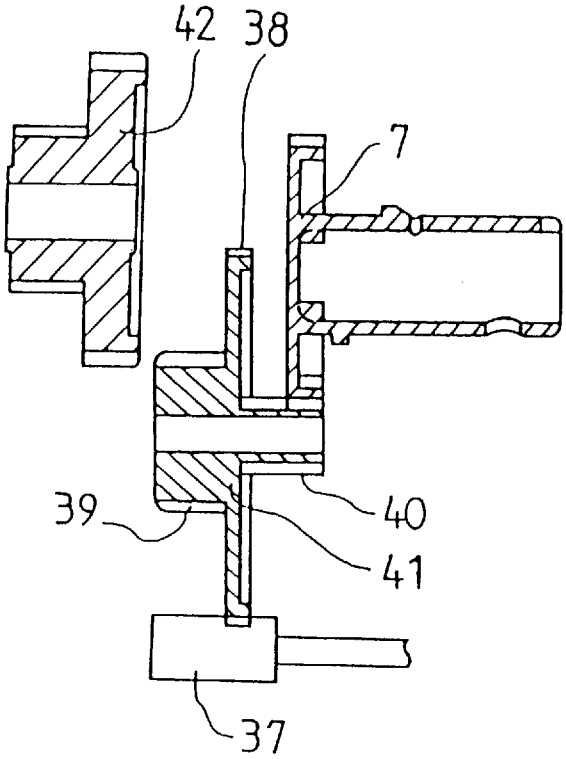
FIG. 7 is a cross-sectional view showing a state where the switching mechanism is switched to a platen roller side.
Figure 8:
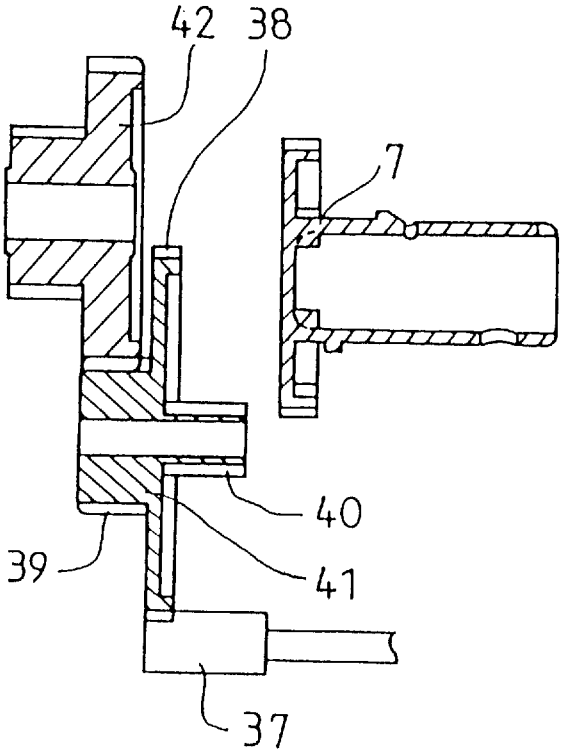
FIG. 8 is a cross-sectional view showing a state where the switching mechanism is switched to a recovery mechanism side.

An line feed (LF) correcting operation, to be described, is a feature of this invention and is executed when a switching operation between the state of FIG. 7 and the state of FIG. 8 is carried out.

As described above, the kick portion 46 is struck by the carriage 9 to perform the switching operation between the states of the switching mechanism 30 which are indicated by the solid line and the two-dotted chain line as shown in FIG. 5. The operation will be described with reference to FIG. 6.

Figure 6:
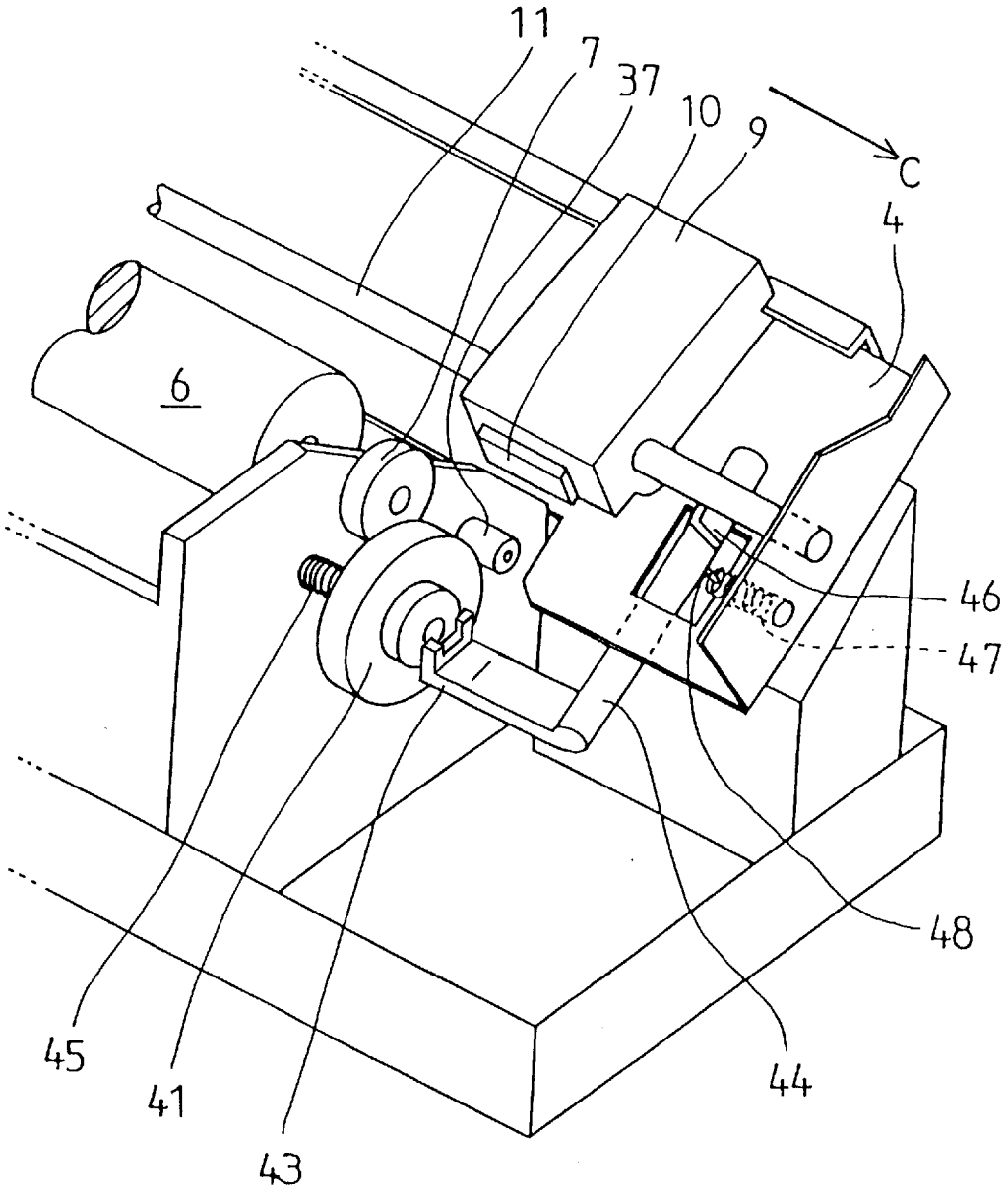
FIG. 6 is a rear perspective view which with the purge mechanism of the ink jet printer removed.

FIG. 6 is a perspective view showing the ink jet printer 1 as observed by one standing behind the printer. The purge mechanism 32 and its elements are not shown to better portray the position of the carriage 9 and the switching mechanism 30. The carriage 9 is located at the standby position HP (FIG. 3). Accordingly, the kick portion 46 is not contacted by the carriage 9. Thus, its position is that shown by the solid line in FIG. 5. Therefore, the urging force of the pull spring 47, having one end hooked to the side wall of the subframe 4 acts on the spring hook 48, and the idle kicker 43 pushes the idle gear 41 against the urging force of the compression spring 45A. Accordingly, as shown in FIG. 6, the tooth gear 40 of the idle gear 41 (not visible in FIG. 6) and the platen gear 7 are engaged with each other to transmit the driving force of the motor gear 37 to the platen roller 6.

When the carriage 9 is shifted along the carriage shaft 11 in the direction indicated by arrow C, the carriage 9 stops at the purge position CP (FIG. 3). At this time, the kick portion 46 is struck by the lower portion of the carriage 9 and it is moved to the position shown by the two-dotted chain line of FIG. 5. In this state, the urging of the pull spring 47 is overcome as described above, and the idle gear 41 is moved away from the platen gear 7 by the urging of the compression gear 45A and engaged with the purge gear 42 (FIG. 5).

In the ink jet printer 1 as described, the driving of the carriage 9 and the print head 10 is controlled, in accordance with an instruction signal from the host 22 while the print sheet supplied from the sheet supply cassette 5 or the manual sheet supply portion 3 is fed by the platen roller 6, to perform a print operation of characters, symbols, and figures on a print sheet. During the print operation, the print sheet is fed by the platen roller 6 until a line to be printed faces the print head 10 and is stopped at that position. Thereafter, the carriage 9 is driven at a predetermined print speed by the CR motor 12. During the driving, the print head 10 jets the ink in accordance with an instruction signal to perform the print operation.

The operation of the ink jet printer 1 contains a series of shift operations of the carriage 9, such as an operation of shifting the carriage 9 at a predetermined print speed during the execution of printing, an operation of shifting the carriage 9 to a print start position after line feed, an operation of retracting the carriage 9 to the standby position HP when the print sheet is supplied or discharged, an operation of shifting the carriage 9 to the purge position CP to recover the print head 10, and an operation of shifting the carriage 9 from the purge position CP after the recovery of the print head 10.

Figure 9:
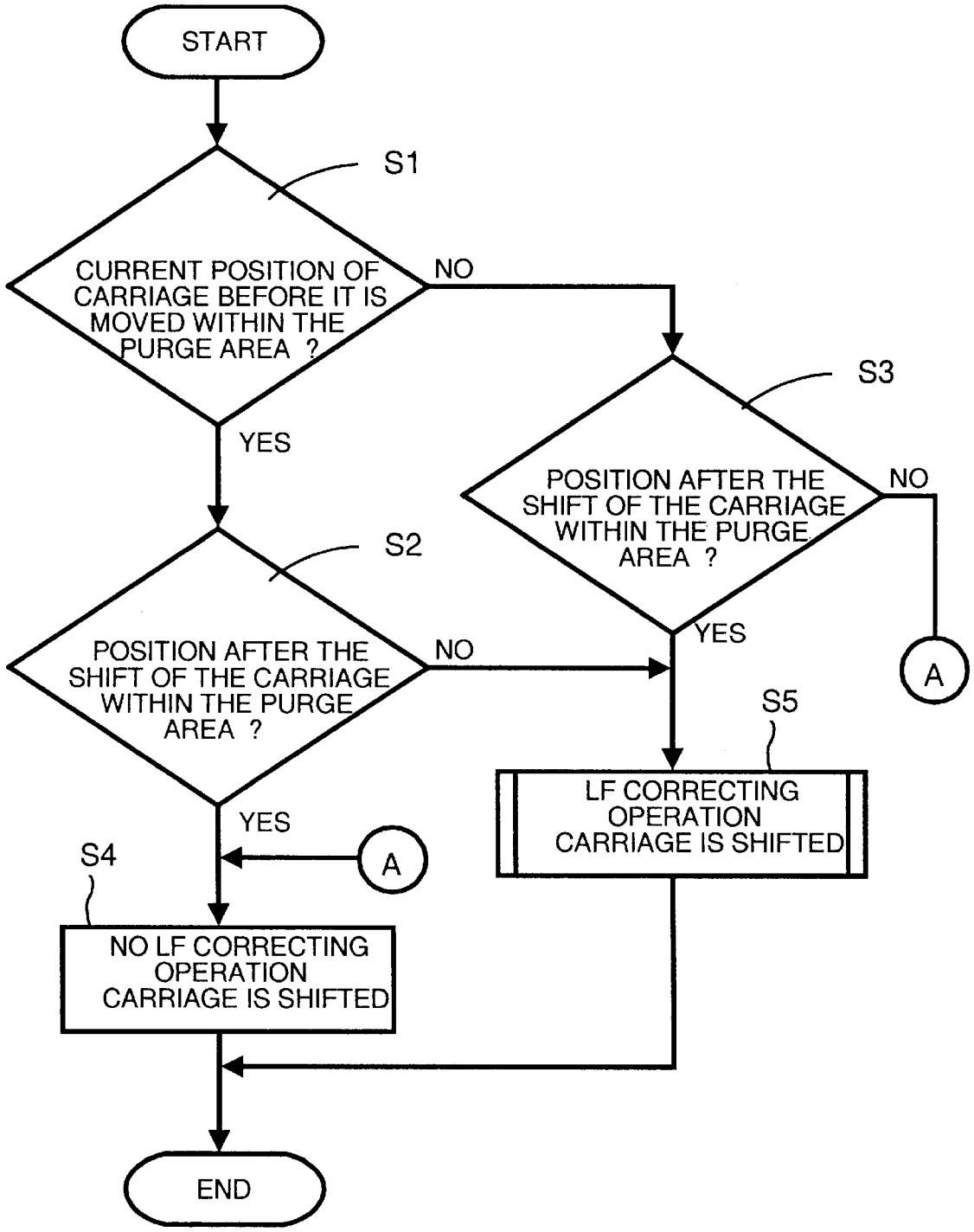
FIG. 9 is a flowchart for a control routine when carriage shift is instructed.

The series of shift operations of the carriage 9 (except for the shift operation during the printing operation) as described above will be described in detail with reference to a flowchart of FIG. 9.

Upon the input of an instruction to shift the position of the carriage 9. The current position of the carriage 9, before it is moved, is checked in step S1. It is judged whether the current position is within the purge area (see FIG. 3). If the current position is within the purge area (S1: Yes), the program goes to step S2. In step S2, the position of the carriage 9 after the movement is calculated on the basis of the current position of the carriage 9 and the content of the carriage shift instruction, i.e., the amount of shift and it is judged whether the new position will be within the purge area. If the current position of the carriage 9 is judged not to be within the purge area (S1:NO), the program goes to step S3 to judge whether the position after the shift of the carriage 9 is within the purge area.

If the judgment of step S2 is Yes or the judgement of step S3 is NO, the program goes to step S4. Accordingly, the program goes to the step S4 only when the carriage 9 does not pass over the standby position HP (see FIG. 3) during the shift of the carriage. In step S4, the carriage 9 is shifted in accordance with the shift instruction. However, no LF correcting operation is carried out because it is not followed by a gear switching operation in the switching mechanism 30 and, thus, correction is unnecessary.

When the judgment of the step S2 is No or the judgment of the step S3 is YES, the program goes to step S5. That is, the program goes to the step S5 only when the carriage 9 passes over the standby position HP during its shift. In step S5, the carriage 9 is shifted in accordance with the shift instruction, and the LF correcting operation is carried out because it is followed by the gear switching operation of the switching mechanism 30. It is not necessarily easy to perform the smooth switching operation due to inertia of the platen roller 6 or a phase shift of the tooth ends of the gears which are engaged with each other.

When the carriage 9 is shifted in either step S4 or S5, the flow is finished.

Figure 10:
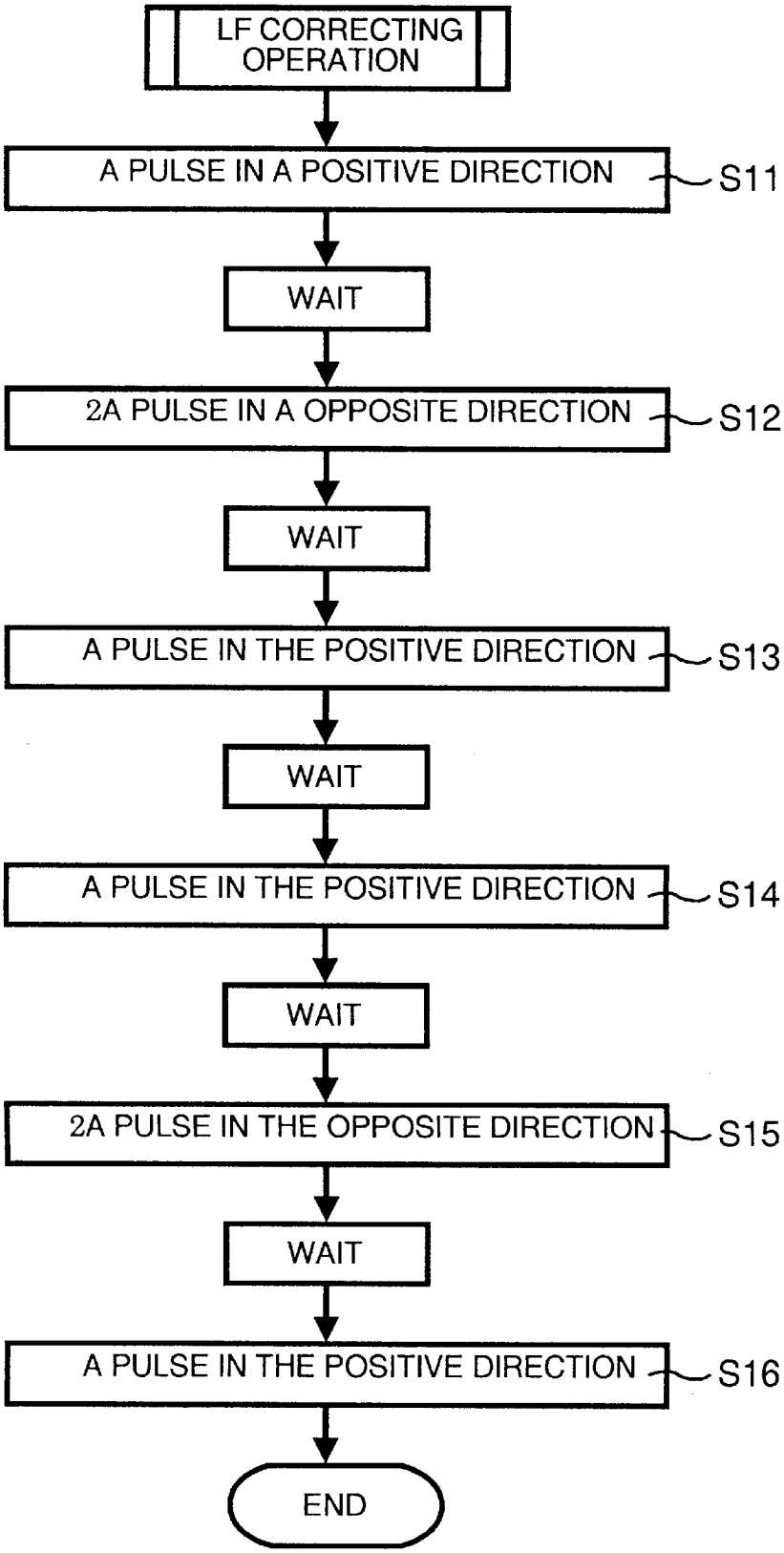
FIG. 10 is a flowchart for a correcting operation of an LF motor to switch a gear linkage.

Next, the LF correcting operation which is executed during the carriage shift of S5 will be described with reference to the flowchart of FIG. 10. In order to carry out the LF correcting operation, the CPU executes the LF correction program stored in the ROM 24 to slightly reciprocatively rotate the LF motor 29 according to a series of processes as described below.

First, in step S11, the LF driving circuit 26 produces a predetermined number of pulses in a clockwise direction (shown by arrow C of FIG. 5). The pulse number may be set to any value that has the idle gear 41 rotating through an angular range (amplitude) which is smaller than one-half of the tooth width. The number of pulses is hereinafter referred to as the "A pulse". Therefore, the idle gear 41 is slightly rotated in the clockwise direction to the extent that it does not move more than one-half of the tooth width. After the program waits for a moment, pulses whose number is twice as large as the A pulse are produced in the opposite, or counterclockwise, direction in step S12, so that the LF motor 29 is slightly rotated in the opposite direction. At this time, the rotation amount is twice as large as that of step S11 or rotation amount slightly less than one tooth width. The program again waits for a moment, and the A pulse is then again produced in the clockwise direction in step S13. Therefore, the LF motor 29 is slightly rotated in the clockwise direction to be returned substantially to the position before its rotational motion in step S11.

The operation from the step S11 to step S13 serves to allow disengagement of the idle gear 41 of the switching mechanism 30 from the gear to which it has been linked. That is, as each of the respective parts, such as the gears and the support shafts therefor, has constant inertia, in many cases distortion occurs in the support shafts, and the tooth face of the idle gear 41 and the tooth face of the other gear which are engaged are tightly pressed against each other, so that a strong frictional force occurs between the teeth faces. In such cases, the disengagement of the gears is not possible using only the pushing of the compression spring 45A or the urging of the pull spring 47. Accordingly, in steps S11 to S13, an effort is made to move the idle gear 41 in both the clockwise (forward) and counterclockwise (backward) directions in an angular range (amplitude) of less than one-half of the tooth width of the idle gear 41 on either side of the start position, whereby the tight contact between the gears is released and the strong frictional force between the tooth face of the idle gear 41 and the tooth face of the other engaged gear is broken, so that these gears can be smoothly disengaged from one another. A slight time lag is set between the driving operations of the LF motor 29 because a slight time is required to release the distortion state of the support shaft due to the inertia of each part.

When the gear disengagement is complete, the A pulse is produced in the clockwise direction, in step S14, after the program has waited for a moment. Therefore, the LF motor 29 is slightly rotated in the clockwise (forward) direction. After the program waits for a moment, the pulses whose number is twice as large as the A pulse are produced in the counterclockwise direction in step S15. Therefore, the LF motor 29 is slightly rotated in the counterclockwise direction. At this time, the rotation amount is twice as large as that of step S14. After the program again pauses for a moment, the A pulse is again produced in the clockwise direction in step S16. Therefore, the LF motor 29 is slightly rotated in the clockwise direction and returned to the position before the rotational motion in S14, thereby completing the flow of this process.

The operation from steps S14 to S16 is to link the idle gear 41 of the switching mechanism 30 to a new link target or operating element. That is, the operation is carried out because there are many cases where the idle gear 41, which is disengaged from the previous link target, is not necessarily coincident in phase with the tooth end of a new link gear, and the tooth gears abut against each other so that the gears cannot engage with one another.

In the steps S14 to S16, the idle gear 41 is swung in both the clockwise (forward) and counterclockwise (backward) directions at an angular amplitude less than half of the tooth width to position the teeth and grooves of the gears for smoothly linking the gears. The program waits for a moment between the driving operations of the LF motor 29 because a slight time is required from the time when the teeth and grooves of the gears oppose one another until the time when the idle gear 41 is actually moved and the gear linkage is completed. Further, the program waits for a moment between the disengagement correcting operation and the linkage (engagement) correcting operation of the gears (between steps S13 and S14) because a slight time is required to move the idle gear 41 from the previous link target to the new link target.

Figure 11:
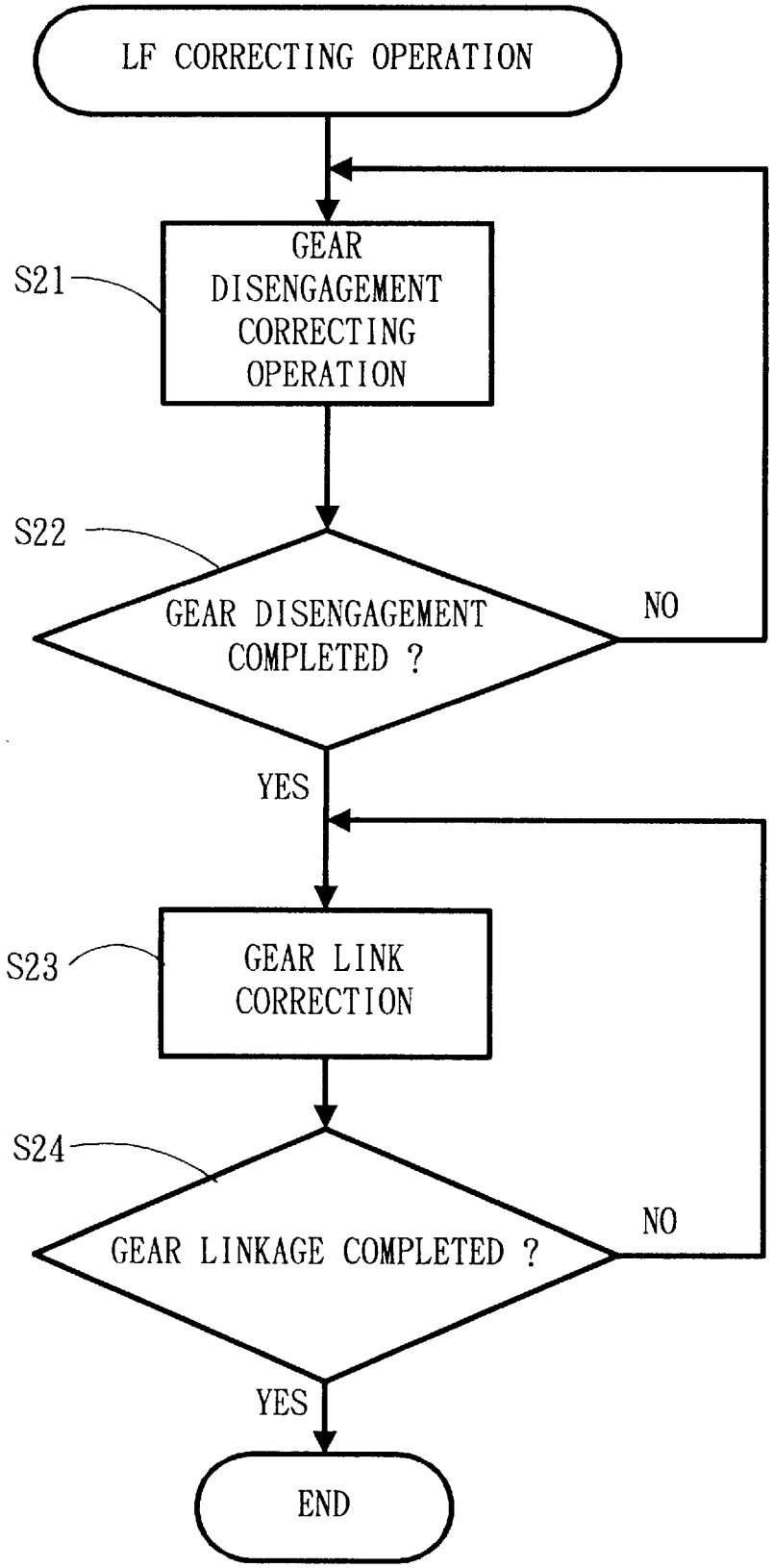
FIG. 11 is a flowchart for repeating the correcting operation.
Figure 12:
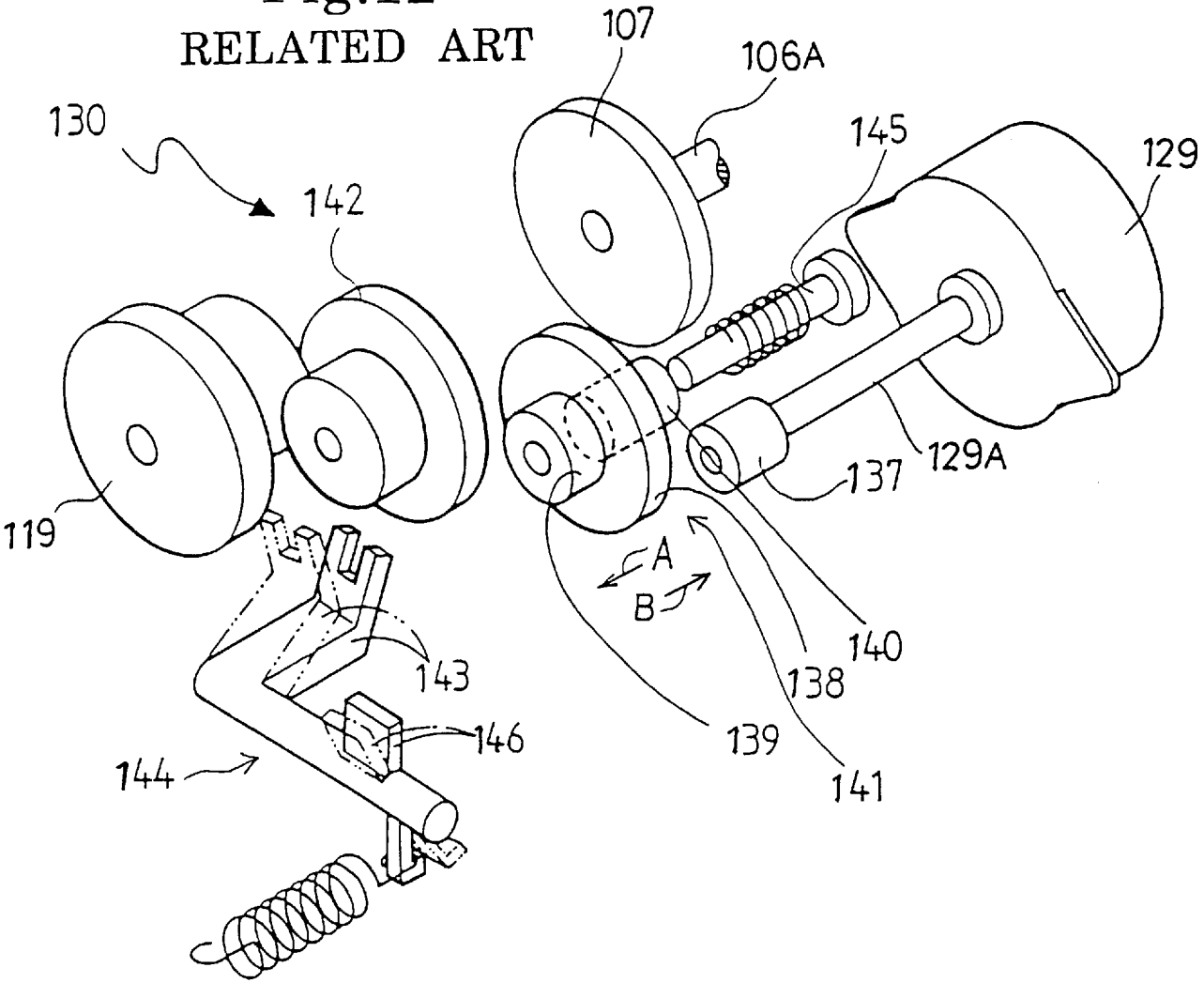
Fig.12 RELATED ART
FIG. 12 is a diagram showing the structure of a switching mechanism of a conventional transmission gear.
Figure 13:
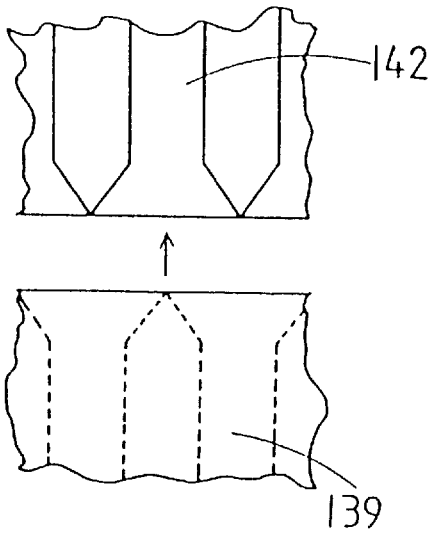
Fig.13 RELATED ART
FIG. 13 is a diagram showing a conventional gear having tapered tooth ends.

The correcting operation, as described above, may be repeated because in some cases only one correcting operation is insufficient due to the inertia of the platen roller 6 and the balance with the driving force of the LF motor 29. The operation when such is the case will be described with a flowchart of FIG. 11.

In this case, in step S21, the gear disengagement correcting operation is first carried out. The gear disengagement correcting operation is the operation from the step S11 to step S13 of the flow chart of FIG. 10. In step S22, it is judged whether the gear disengagement is completed. The disengagement, or engagement, is determined based upon the output of the sensors 33–35. For example, in this case, if the gear disengagement involves disengagement of the idle gear 41 from the purge gear 42, because the purge HP sensor 32 always outputs a signal (alternating high and low during recovery operations), disengagement is complete when the signal maintains a steady state. If the disengagement is not completed (S22:No), the disengagement correction of step S21 is repeated. If the disengagement is completed (S22:Yes), the program goes to a step S23. In step S23, the gear link correction is carried out. In step S24, it is judged whether the gear linkage to the link target is completed. If the gear linkage is not completed (S24:No), the gear linkage correction of step S23 is repeated. If the gear linkage is completed (S24:Yes), this flow is finished.

As described above, in the ink jet printer 1 of the embodiment, the kick portion 46 of the switching mechanism 30 is moved through the movement of the carriage 9 to alter the link target of the gear. Therefore, when the carriage 9 is located within the print area of the carriage shift range M, the idle kicker 43 pushes the idle gear 41, by the urging of the pull spring 47 of the switching mechanism 30, to engage the tooth gear 40 with the platen gear 7. On the other hand, when the carriage 9 is located within the purge area, the urging of the pull spring 47 is overcome, and the tooth gear 39 of the idle gear 41 is linked to the purge gear 42 by the urging of the compression spring 45A.

When the carriage 9 is moved, it is judged from the position before and after the movement whether the carriage 9 passes over the standby position HP through the movement of the carriage 9. Therefore, when the carriage 9 is beyond the standby position HP, that is, the link target of the gear of the switching mechanism 30 is altered, the LF motor 29 is subjected to the predetermined correcting operation, and the link state of the gear is smoothly switched.

In this case, the LF motor 29 carries out the disengagement correcting operation, that is, it is reciprocatively rotated within the half of the tooth width range in the forward and backward directions when the idle gear 41 of the switching mechanism 30 is disengaged from the link target which has been linked to the idle gear 41. Therefore, even in a case where distortion occurs in the support shaft of the gear due to inertia of each part and, thus, the backlash is actually extinguished, so that the gears are fixed to each other, these gears can be smoothly disengaged from each other by the swing of the idle gear 41 in both the directions. This effect is greater particularly in a case where the idle gear 41 is disengaged from the platen gear 7 having the same shaft as a part which has a large inertia or large mechanical load, such as the platen roller 6.

In addition, when the idle gear 41 which is disengaged from a link target is linked to a new link target, the link correcting operation of reciprocatively rotating the LF motor 29 in both the forward and backward directions within the half of the tooth width is carried out. Therefore, by swinging the idle gear 41 in both of the directions, the teeth and the grooves are faced to each other between both the gears and the gear linkage between the gears can be smoothly performed.

Further, when the gear disengagement or linkage is not completed by carrying out the correcting operation only once, the correcting operation is repetitively carried out, so that the gear switching operation can be surely performed, e.g., steps S11 through S13 may be repetitively executed to obtain disengagement before exerting steps S14 through S16. Subsequently, steps S14 through S16 may be repeated.

The invention is not limited to the above embodiment, and various modifications and alteration may be made to the above-mentioned embodiment without departing from the subject matter of the invention.

For example, in the embodiment as described above, the tooth end of each gear of the idle gear 41, the platen gear 7 and the purge gear 42 may be designed in a tapered form to assist the teeth of the gears engage with one another. In this case, the gear linkage can be more smoothly performed in cooperation with the correcting operation of the LF motor 29.

Furthermore, in the embodiment as described above, the idle gear 41 is selectively linked to one of the platen gear 7 and the purge gear 42. However, if the LF motor 29 has surplus torque, the tooth gear 40 of the idle gear 41 and the platen gear 7 may be linked to each other at all times, and only the linkage between the tooth gear 39 and the purge gear 42 may be switched by the carriage 9. In this case, the link correction is only carried out when the idle gear 41 is linked to the purge gear 42, and the disengagement correction is only carried out when the idle gear 41 is disengaged from the purge gear 42.

What is claimed is:

1. An ink jet print recording apparatus having an ink jet type print head for jetting ink from an ink discharge port onto a print medium to print an image on the print medium, recovering means for recovering the print head, a feeding roller for feeding the print medium and a driving motor for driving said recovery means and said feeding roller, comprising:

a recovery gear provided to said recovery means;

a feeding gear provided to said feeding roller;

a transmission gear which is driven by said driving motor and switchably linked to one of said recovery gear and said feeding gear; and engagement control means for controlling said driving motor to reciprocatively rotate said transmission gear in an angular range which is equal to or smaller than a half of the tooth width of said transmission gear when a link target of said transmission gear is switched, thereby performing a smooth gear switching operation, wherein said transmission gear is moved in a shaft direction to switch the link target.

2. The ink jet print recording apparatus as claimed in claim 1, wherein said recovery means comprises a suction pump for sucking ink from the ink discharge port of said print head to recover said print head, a carriage which is movable in parallel to said feeding roller and on which said print head is mounted, and switching means for moving said transmission gear in the shaft direction to switch the link target interlockingly with the movement of said carriage.

3. The ink jet print recording apparatus as claimed in claim 2, wherein said engagement control means drives said driving motor when said transmission gear is to be disengaged from the link target by said switching means.

4. The ink jet print recording apparatus as claimed in claim 2, wherein said engagement control means drives said driving motor when said transmission means is to be engaged with the link target by said switching means.

5. The ink jet print recording apparatus as claimed in claim 2, wherein said engagement control means drives said driving motor when said transmission gear is to be disengaged from the link target by said switching means and also drives said driving motor when said transmission gear is to be linked to a new link target.

6. The ink jet print recording apparatus as claimed in claim 1, further comprising a compression spring associated with said transmission gear causing said transmission gear to move in the shaft direction toward linkage with said recovery gear.

7. An ink jet printing device, comprising:

a printhead mounted on a reciprocatively movable carriage;

a rotatable platen along which the carriage moves and which serves as a recording medium feeding device;

a recovery device for recovering the printhead positioned adjacent one end of the platen;

a driving motor driving at least one of the platen and the recovery device;

a recovery gear attached to the recovery device;

a feed gear attached to the platen;

a transmission gear driven by the driving motor and switchably linked to one of the platen through the feedgear and the recovery device through the recovery gear; and a controller for controlling the engagement of the transmission gear with the one of the platen and the recovery device, wherein the controller causes the transmission gear to reciprocatively rotate a predetermined amount during disengagement and engagement of the transmission gear with the recovery gear and the feed gear.

8. The ink jet printing device according to claim 7, wherein the predetermined distance is approximately one-half a tooth width of the transmission gear.

9. The ink jet printing device according to claim 7, wherein the reciprocative rotation comprises rotation for the predetermined distance in a first direction and then rotation in the opposite direction for approximately twice the predetermined distance.

10. The ink jet printing device according to claim 9, wherein the reciprocative rotation further comprises a further rotation for approximately the predetermined distance in the first direction to return the transmission gear to a start position.

11. The ink jet printing device according to claim 10, further comprising detecting means for determining whether the transmission gear has disengaged or engaged with the one of the recovery gear and the feed gear.

12. The ink jet printing apparatus according to claim 7, wherein the transmission gear is always engaged with the feed gear and is selectively engaged and disengaged with the recovery gear.

13. The ink jet printing apparatus according to claim 7, wherein gear teeth of the transmission, recovery and feed gears have tapered end surfaces to facilitate engagement and disengagement.

14. A method of changing over an action of a printing device from one of advancing a print medium to one of recovery of a printhead, comprising the steps of:

determining a position of the printhead;

determining whether a change of action is required and, when a change of action is required, conducting a gear disengagement operation; and subsequently conducting a gear engagement operation, wherein the gear disengagement operation comprises the steps of:

providing drive for rotating a transmission gear in a first direction for a predetermined distance;

providing drive for counterrotating the transmission gear at least the predetermined distance in a second direction; and providing drive for return rotating the transmission gear in the first direction to substantially the starting position.

15. The method according to claim 14, further comprising the step of detecting whether disengagement of the gear teeth has occurred.

16. The method according to claim 15, wherein when the detecting step determines disengagement has not occurred, further comprising the step of repeating the steps of providing drive for rotating, counterrotating and return rotating.

17. The method according to claim 14, wherein the gear engagement operation comprises the steps of:

providing drive for rotating a transmission gear in a first direction for a predetermined distance;

providing drive for counterrotating the transmission gear in a second direction for approximately twice the predetermined distance; and providing drive for return rotating the transmission gear approximately the predetermined distance in the first direction, the rotating, counterrotating and return rotating causing teeth of the transmission gear to align with gaps between teeth of a gear to be engaged.

18. The method according to claim 17, further comprising the step of detecting whether engagement of the gear teeth of the transmission gear with the gaps between the teeth of the gear to be engaged has occurred.

19. The method according to claim 18, wherein when the detecting step determines engagement has not occurred, further comprising repeating the steps of providing drive for rotating, counterrotating and return rotating.

20. The method according to claim 17, further comprising the step of waiting for a predetermined period after each step of providing drive.

* * * * *